US006598828B2

(12) United States Patent
Fiebick et al.

(10) Patent No.: US 6,598,828 B2
(45) Date of Patent: Jul. 29, 2003

(54) INTEGRAL DATA ACQUISITION CAPACITY

(75) Inventors: Wayne A. Fiebick, Ridgecrest, CA (US); Keith E. Clark, Ridgecrest, CA (US); Patrick Donohue, Ridgecrest, CA (US); Sue Oah, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 43 days.

(21) Appl. No.: 09/801,126

(22) Filed: Mar. 5, 2001

(65) Prior Publication Data

US 2003/0071165 A1 Apr. 17, 2003

(51) Int. Cl.[7] ..... G08C 25/00

(52) U.S. Cl. ..... 244/118.1; 244/3.1; 244/117 R; 324/512; 324/555; 340/945; 340/946; 340/971; 73/167; 73/865.3; 73/865.9

(58) Field of Search ..... 244/3.1–3.22, 244/117 R, 118.1; 342/25, 52–58, 61, 62, 63, 64, 65, 70, 71, 72, 175, 190, 191, 195, 196, 197; 89/1.8, 1.1, 1.11; 340/945, 946, 971; 324/500, 503, 512, 513–536, 555, 556; 73/167, 865.3, 865.9, 866.1

(56) References Cited

U.S. PATENT DOCUMENTS 4,034,370 A * 7/1977 Mims ..... 342/196
4,227,194 A * 10/1980 Herman et al. ..... 342/25
4,339,752 A * 7/1982 Williams et al. ..... 342/196
4,509,048 A * 4/1985 Jain ..... 342/25
4,549,184 A * 10/1985 Boles et al. ..... 342/25
4,562,439 A * 12/1985 Peralta et al. ..... 342/25
4,963,877 A * 10/1990 Wood et al. ..... 342/25
5,172,118 A * 12/1992 Peregrim et al. ..... 342/25
5,229,538 A 7/1993 McGlynn et al.
5,243,349 A * 9/1993 Mims ..... 342/25
5,262,781 A * 11/1993 Evans ..... 342/25
5,349,685 A 9/1994 Houlberg
5,485,384 A * 1/1996 Falconnet ..... 342/25
5,563,601 A * 10/1996 Cataldo ..... 342/25
5,591,031 A 1/1997 Monk et al.
5,614,896 A 3/1997 Monk et al.
5,624,264 A 4/1997 Houlberg
5,992,290 A 11/1999 Quebedeaux et al.

OTHER PUBLICATIONS

I–DAP Electrical Schematic Diagrams, Nov. 30, 1999.

* cited by examiner

*Primary Examiner*—Bernarr E. Gregory
(74) *Attorney, Agent, or Firm*—David Kalmbaugh

(57) ABSTRACT

Provided is a modified configuration that permits operation of instrumentation onboard platforms that may experience severe environmental conditions. The instrumentation permits autonomous acquisition of performance data. Acquired data may be recorded for later playback as well as provided to the platform's operator in real time in multiple formats, such as warning lights, digital displays, video, or audio. An application would be for sensor systems used on an automobile to record performance data, providing a warning when routine maintenance is due or a catastrophic failure is imminent. A specific application uses a flight-certified missile launcher pod on an F/A-18 aircraft, as incorporated in the aircraft's wingtip and modified to hold instrumentation conforming, at least in part, to the launcher pod's internal dimensions. This arrangement enables autonomous onboard display and recording of data from the captive carry testing of an AIM-9X missile and follow-on designs that may be based on the AIM-9X.

8 Claims, 9 Drawing Sheets

INTEGRAL DATA ACQUISITION CAPACITY

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention pertains to instrumenting platforms to acquire data. Acquired data may be recorded for later playback as well as provided to a platform operator in real time in multiple formats, such as warning lights, digital, video, or audio. A specific application employs a flight-certified missile launcher modified to hold instrumentation conforming, at least in part, to the launcher's internal dimensions, while enabling autonomous display and recording of data that may occur during severe environmental stress of the aircraft carrying the modified launcher.

BACKGROUND

Military aircraft may carry multiple missiles, an example being the air-to-air AIM-9X SIDEWINDER. An aircraft's missile station may combine a missile and its corresponding missile launcher, such as the LAU-7 missile launcher pod for the AIM-9X carried on an F/A-18. A fire control system, responsive to a pilot's input, communicates with each missile station to monitor status, prepare for launch, and launch. A weapon system interface transfers the commands from the fire control system as data for monitoring and controlling the missile stations.

The weapon system interface includes an umbilical and may include a data link. The umbilical provides communications between the fire control system and missile prior to launch, while the data link provides communications post-launch to some missile types, the AIM-9X not being of this type. For "on-range" testing, the AIM-9X may have a telemetry data link installed in place of the warhead for the purpose of telemetering data to a receiver station on the range. To preserve resources and reduce costs, many flight tests of missiles are "captive carry" tests, i.e., the missile is not launched but its seeker is activated and the aircraft flown as a simulated missile to determine missile seeker performance against a variety of targets and target backgrounds. Such captive carry missions may also include training exercises for pilots, weapons controllers, load crews, test range instrumentation personnel, or other operators, as well as missile system performance testing.

For conventional missiles, a simple connector can be used to route data using cabling pre-installed in the aircraft wings. Thus, a functioning missile may be represented as a simulation to the aircraft's fire control system. While this capability has achieved some success, it has inherent disadvantages in capturing the data acquired during the test or simulated operation. For example, it requires a ground telemetry station to capture and record data for real-time data acquisition and post-analysis.

Various systems have been employed to simulate missile functions during training and testing, both on the ground and in the air. One such device for simulating pre-launch conditions only, is the Integration Test Vehicle (ITV), a specially modified AMRAAM missile. The ITV is completely inert, replacing the warhead with a telemetry unit. However, a simple connector cannot be used with AMRAAM adapted missile stations since the interface to the AMRAAM includes a more complex combination of discrete signals and MIL-STD-1553 serial data with specific timing requirements imposed thereon. Other simulators incorporate unique software specifically designed to function only with a specific missile variant as installed on a specific aircraft variant.

A conventional test apparatus and method is represented by that of U.S. Pat. No. 5,614,896, *Method and System for Aircraft Weapon Station Testing*, issued to Monk et al., Mar. 25, 1997, in which each of a number of an aircraft's weapon stations is able to be function tested via a portable test station incorporating a common electronics module and interchangeable mechanical fixtures. This testing may be done only while the aircraft is on the ground, however.

One of the ways to conduct tests of a missile's function is to simulate an actual launch from an aircraft. To simulate a missile while airborne, various simulators have been devised, an example being one represented in U.S. Pat. No. 5,624,264, *Missile Launch Simulator*, issued to Houlberg, Apr. 29, 1997, and incorporated herein by reference. This simulator provides a realistic simulation of the launch of a missile from an aircraft weapon station incorporating a launcher. The flight of the aircraft and missile are simulated on the ground, however, with vibration and other environmental forces encountered by an actual flight estimated mathematically, if at all.

U.S. Pat. No. 5,591,031, *Missile Simulator Apparatus*, issued to Monk et al., Jan. 7, 1997, describes an apparatus to be used for pilot training that incorporates a pre-launch module, and a data link and data capture module in an inert form-factored missile body for recording all data transfer between the aircraft and the apparatus during the flight. The modifications are incorporated in the missile itself, rather than the aircraft's onboard launcher, hence, only modified missiles are suitable for these training missions.

For each of the above situations, a common disadvantage is the inability to take a missile from stock, mount it on an aircraft and fly it in an "all out" captive test. The present invention overcomes this and other limitations of the above conventional systems while also providing a new capability for a pilot or other operator to redirect a mission based on onboard real time inputs.

SUMMARY OF THE INVENTION

A preferred embodiment of the present invention provides a method and apparatus for configuring an instrumentation package on an aircraft to acquire data autonomously while airborne. The instrumentation package is specifically configured to fit within the interior volume of an existing structure that has been certified at least as to its strength, weight, center of gravity (COG), and Moment of Inertia (MOI). Devices that may exist within the interior volume of the structure may be removed to provide space for the instrumentation. An example existing structure is a flight certified missile launcher (launcher pod) carried on an external stores station of a high performance aircraft. The launcher pod serves as a launcher for a missile such as an air-to-air missile used by the U.S. military. Some launchers have an "air bottle" installed to facilitate cryogenic cooling of the infrared detector on conventional missiles such as the Navy SIDEWINDER AIM-9M. High pressure gas flows from the launcher to the AIM-9M via a thin metal tube in the same umbilical that carries electrical cabling to the missile from the aircraft. The AIM-9X version of SIDEWINDER has a "closed cycle cooler" internal to the AIM-9X, thus the air bottle is not required to be installed in the launcher when an AIM-9X is carried on the launcher station. This air bottle, normally filled with nitrogen ($N_2$) at high pressure, thus, hereinafter referred to as an $N_2$ bottle, and its supporting structure may be removed and replaced with the form-fit instrumentation package.

The instrumentation package may comprise:

- a digital recorder that has suitable flash memory, such as flash RAM, for a typical airborne test mission of one hour or more;
- circuitry for connection to the recorder, various power supplies and an interface to the aircraft and at least one missile that is carried on the weapon station carrying the launcher; and
- connections from the circuitry to various sources of data to include aircraft avionics, displays, missile seeker and controls, and power supplies both internal to the launcher pod and supplied by the aircraft.

The instrumentation package may be configured without changing the external physical configuration of the aircraft or other platform on which it is installed. Further, the installed configuration may minimize requirements for additional certification of the existing structure, e.g., a launcher on a high performance aircraft. This may be accomplished by carefully matching weight, center of gravity (CG), and moment of inertia (MOI) of the instrumentation as installed to that of a standard LAU-7 missile launcher pod. The instrumentation may be used to acquire data autonomously for measuring performance of a system, such as a missile that is being operated in a "captive carry" test while the aircraft is performing maneuvers simulating a missile fly out as well as normal missile operation when acquiring and tracking targets while onboard the aircraft. The instrumentation, as so configured, provides a capability of flight testing a missile and acquiring test data without the need for telemetry of acquired data to a ground site. This capability further provides the flexibility of testing in scenarios where test range instrumentation is not available such as over rugged mountainous terrain or in crowded urban areas.

Of course, if a launcher is used to carry a form-fit instrumentation package, the missile may be incapable of being fired. This is not as limiting as one might think, however. Most flight testing of expensive missiles is done in a "captive carry," so the opportunity for significant use of a preferred embodiment of the present invention, i.e., the modified launcher, is great. Thus a specific application of a preferred embodiment of the present invention lies in acquiring and recording data during captive carry flight testing of a system, specifically an expensive missile. Of course, the data must be reviewed and analyzed at some point, hence, also provided is a portable downloader to capture the data from the aircraft once it has landed. This download capability is facilitated by rugged connectors, to pre-specified limits of environmental stress both internal to the pod and external to the downloader, for connecting cabling from the modified launcher pod to the downloader. Further, data may be presented to an operator in real time, such as a pilot or a weapon system operator, thus facilitating real time re-direction of a mission.

The instrumentation package may be powered by batteries carried within the launcher pod, by power provided by the platform, such as a high performance aircraft, or a combination thereof. The digital recorder may be a "bank" of memory cards that, in toto, represent a digital recorder. The cards may comprise flash memory, such as flash RAM, of 6 GBytes (GB) or more, enough to record a typical one-hour captive carry flight test of a modern missile carried on a high performance aircraft.

Since some of the data may need to be converted to analog, e.g., to be used for real time video display in the cockpit, the circuitry may comprise one or more digital-to-analog (D-A) converter circuits. For conventional, older generation systems, analog-to-digital circuits may be used. In addition to the data provided from existing systems onboard the aircraft and the missile, additional sensors may be added and tied in to the instrumentation for purposes of collecting enhanced data such as would be useful to describe unique test conditions, implementation of supplemental systems, or prototype improvements to the missile or aircraft systems.

Since the instrumentation package, in a preferred embodiment, will be used with military systems, utilization of a MIL-STD-1553 data bus for transfer of data is preferred. Because the data will be used to measure dynamic performance, precise timing may be provided using the InterRange Instrumentation Group (IRIG) standard for both actual and pseudo-timing.

One embodiment visualizes a missile launcher affixed to an aircraft incorporating onboard sensors and electronics as part of an integrated weapon delivery system. An example structure is a LAU-7 missile launcher pod for launching the AIM-9 SIDEWINDER air-to-air missile from a high performance aircraft such as an F/A-18. The LAU-7 is a good choice for modification to accept an instrumentation configuration because it is flight certified as to strength, weight, center of gravity (COG), and Moment of Inertia (MOI). A primary need exists for "captive carry" testing of an AIM-9X missile as well as any follow-on designs based on the AIM-9X. U.S. Navy predecessor versions of the AIM-9X required the $N_2$ bottle 120 for cryogenic cooling of the missile's IR detector while the missile was operating onboard the aircraft in an acquisition or search mode. As-built modifications, per a preferred embodiment of the present invention designated In-Flight Data Acquisition Pod (I-DAP), may permit operation with minimal further certification.

In addition to instrumentation to be housed within an existing structure, provided is a method for configuring the instrumentation package as a conforming assembly within an existing certified structure. A preferred embodiment of the present invention is designed and built by:

- measuring available space within the interior of the structure;
- designing electronics modules with connectors and cabling to fit within the structure;
- fabricating the modules, connectors and cabling; and
- packaging the modules, connectors and cables to withstand severe environmental conditions and to fit within the available space as the instrumentation package described above.

The instrumentation package may be installed without changing the external physical configuration of the structure or the platform, and may minimize requirements for additional certification of the structure as modified internally by said instrumentation package. Assuming the existing structure holds at least one component, installed components may be removed along with any supporting structure unique to them. Provision is made for ready download of data acquired during operation of a system onboard the platform through a compatible connector and cabling to an off-platform downloader, i.e., a portable data acquisition system, or downloader, made available for downloading data at the end of a test. Additionally, a capability may exist to provide at least some of the data to an operator of the platform or vehicle in real time, through installation of appropriate circuitry, connectors, and cabling and provision of suitable power.

Advantages of preferred embodiments of the present invention, as compared to conventional systems, include permitting:

- use of commercial off-the-shelf components (COTS) for at least part of the configuration;
- conservation of test resources;
- reduced time for test preparation;
- improved data quality;
- reduced (or eliminated) need for telemetry;
- improved data security;
- standardized configuration;
- ready adaptation of existing flight-certified configurations;
- simplified test sub-systems using COTS hardware where possible;
- simplified design of alternate configurations;
- inexpensive fabrication;
- reduced man-hours for operation;
- reduced system complexity;
- reduced system capital costs;
- improved robustness;
- low maintenance costs;
- increased flexibility;
- high reliability;
- use of existing flight-certified connectors;
- use of HOTLink™ standard serial digital video and manchester-encoded serial telemetry (TM) data;
- form-fit within a launcher to replace an item(s) not needed during captive carry testing such as the internal $N_2$ bottle used to assist with external cryogenic cooling of the seeker head of early versions of the AIM-9 SIDEWINDER that is not needed by the internally-cooled AIM-9X;
- adaptation and use of modules while allowing full functional communication between the aircraft and the captive missile;
- no approval needed for authorized frequencies and broadcast times since TM can be shutoff and all recording done internally;
- mobility and maneuverability of the aircraft is enhanced since there is no concern about "blanking" a ground telemetry site;
- mechanical, structural, electrical, shock, thermal management, power management, and environmental constraints to pre-specified limits of environmental stress both internal to the pod and external to the downloader are met with minimal certification; and
- ready upgradability.

Embodiments of the present invention can be applied to non-airborne platforms including those operating above and below terra firma and the water's surface. Thus, it can be applied to other than military operations to include mining, recreation, geologic and oceanographic surveys, etc. Finally, a preferred embodiment of the present invention may be used in realistic training, providing feedback that otherwise might be available only from a less objective source, such as operator debriefing, thus providing more accurate and easily interpreted data for training and updating.

Preferred embodiments are fully disclosed below, albeit without placing limitations thereon.

DETAILED DESCRIPTION

Figure 1:
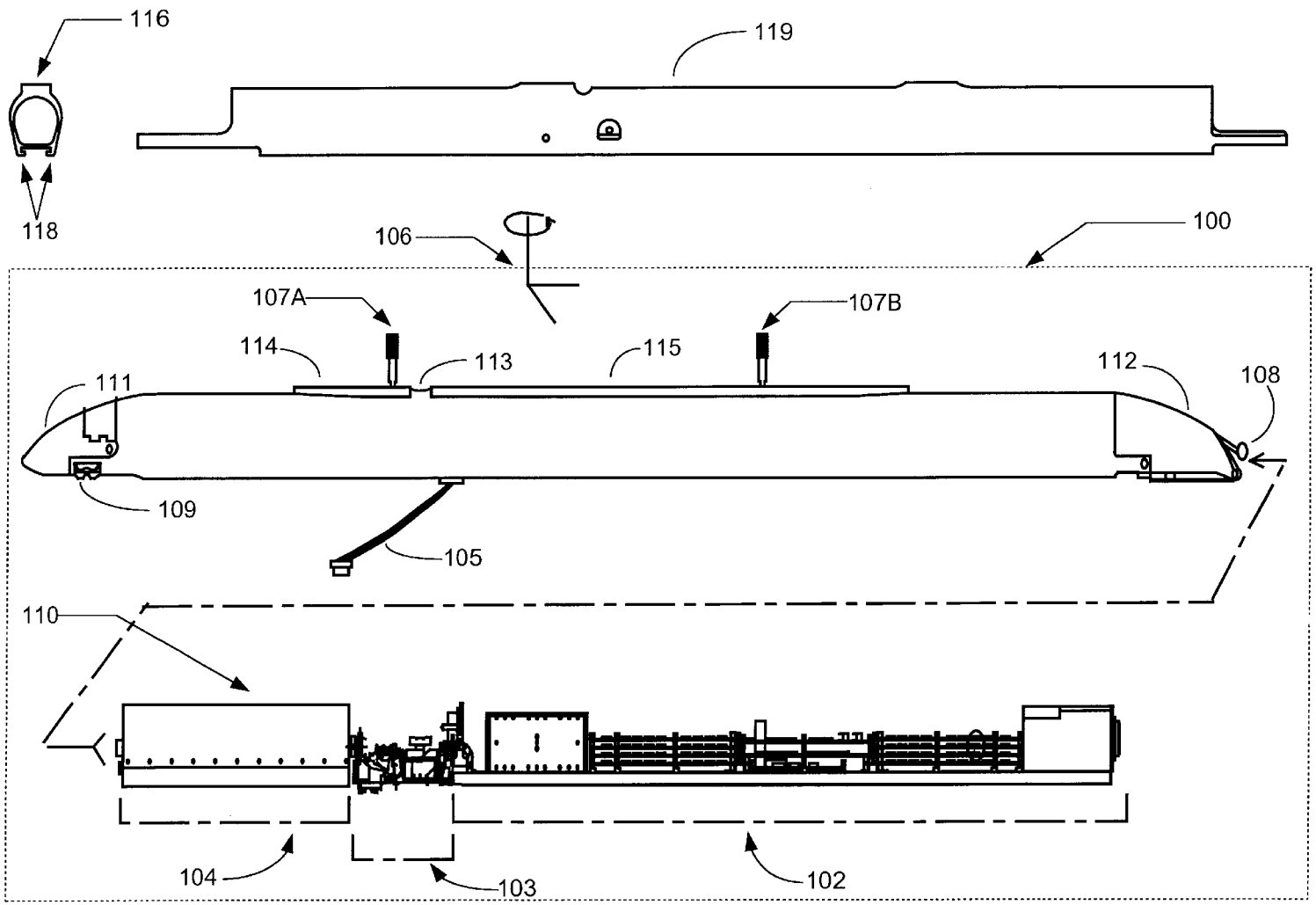
FIG. 1 depicts side views of the unmodified outside of a launcher and the inside as configured for use with a preferred embodiment of the present invention.
Figure 8:
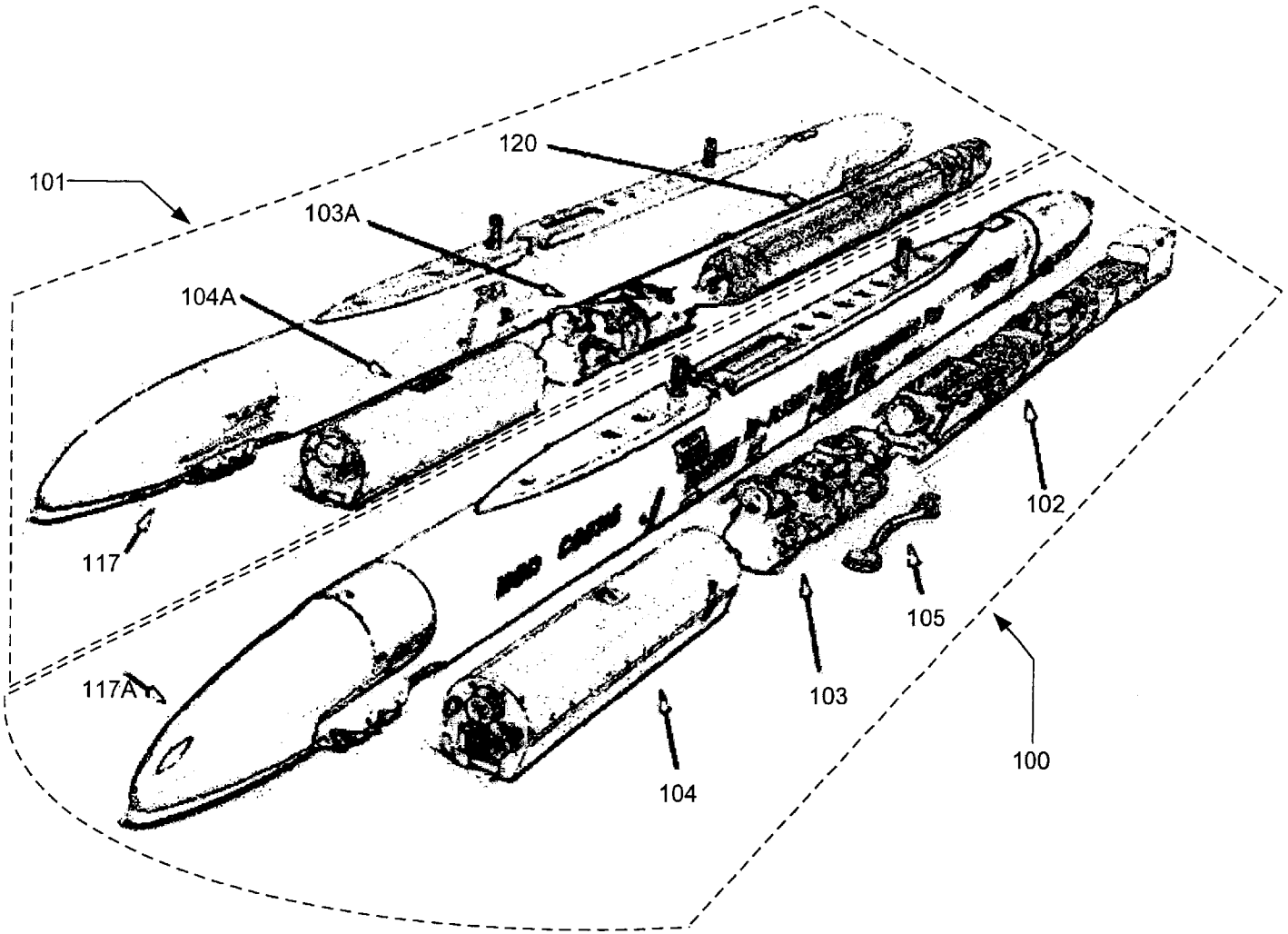
FIG. 8 is an artist's rendition comparing the major components of the standard LAU-7 launcher pod with those of the I-DAP.

Referring to FIG. 8, in a preferred embodiment of the present invention, a LAU-7 missile launcher pod 101 is modified to carry instrumentation for acquisition of data. The modifications are such that the modified pod, designated the In-Flight-Data Acquisition Pod (I-DAP) 100, retains its existing flight certification This download capability is facilitated by rugged connectors, to pre-specified limits of environmental stress both internal to the pod and external to the downloader, with minimal additional analysis or expensive flight testing. Referring to FIG. 1, the resultant I-DAP 100, with its instrumentation package, termed a data acquisition system 110, comprises a self-contained solid state data recorder, with associated interface, timing and control electronics, that is designed to interface to, and record data (video and telemetry) from a missile, such as the AIM-9X Short Range Air-to-Air Missile, commonly known as SIDEWINDER. The data provide a measure of missile performance, specifically the operation of the missile's seeker, while the missile is carried on a wing tip of a high performance aircraft, such as an F/A-18. A visual comparison of the major components of the standard LAU-7 launcher pod 101 to the I-DAP 100 is provided in FIG. 8. The power supply assembly 104A, designated PP 2581, from the standard LAU-7 101 is replaced with the commercially available LAU-7D/A power supply assembly 104. The mechanism assembly 103A is replaced with the modified mechanism assembly 103. A mid-body cable 105 is added and the $N_2$ bottle 120 is replaced by the electronics in the tray assembly 102. Outer dimensions and fixtures of the standard LAU-7 101 remain essentially unchanged for the I-DAP 100.

The electronics and memory that make up the data acquisition system 110 to be inserted into an existing structure are "form-factored" to replace devices normally carried within a conventional LAU-7 pod 101. Within the LAU-7 pod 101 for the predecessors of the AIM-9X, the $N_2$ bottle 120 is used to effect cryogenic cooling of the IR detector of these earlier designs. The $N_2$ bottle 120 is not necessary during a captive carry test of the AIM-9X (as well as any of the AIM-9X as yet to be realized successors) because cooling of the IR detector head is done via a system carried onboard the AIM-9X itself.

During flight testing, I-DAP 100 is powered from both the aircraft's 400-Hz power (not separately shown) and the aircraft's +28 VDC power (not separately shown). When I-DAP 100 is being downloaded on the flight line at mission completion, it is powered by the UPS 409 battery (not separately shown) incorporated in the downloader 401 of FIG. 4. It maintains functionality at the mid-body umbilical (cable) 105, while monitoring and recording traffic on the MIL-STD-1553 data bus, 404 of FIG. 4, between the missile, the aircraft, and the I-DAP 100. A bus interface such as that described in U.S. Pat. No. 5,349,685, *Multipurpose Bus Interface Using a Digital Signal Processor*, issued to Houlberg, Sep. 20, 1994, incorporated herein by reference, may be used for this purpose. In addition, through the use of another interface described in U.S. Pat. No. 5,229,538, *Multiple Smart Weapons Employment Mechanism*, issued to McGlynn et al., Jul. 20, 1993 and incorporated herein by reference, or a mechanism such as represented in U.S. Pat. No. 5,992,290, *Aircraft Interface Device and Crossover Cable*, issued to Quebedeaux et al., Nov. 30, 1999, incorporated herein by reference, the usefulness of a preferred embodiment of the present invention may be extended to onboard weapon stations other than that on which the I-DAP 100 is mounted. Referring to FIG. 1, analog real-time video from the missile seeker is sent to the I-DAP 100 pylon connector 113.

The I-DAP 100 provides testing capabilities heretofore unavailable. It enhances pilot or operator awareness by providing real time video connections, 402 in FIG. 4, to the aircraft wingtips (not separately shown) that can, in turn, be monitored by the pilot (or operator) on a cockpit (or remote) receiver (not separately shown) such as a digital display interface (DDI) (not separately shown). This is accomplished by modifying the aircraft to allow the missile video 402 to access video interfaces (not separately shown) in place on the aircraft's inboard stations (pylons) (not separately shown). For example, F/A-18s have been modified to allow access to the extant video interface on stations 2 and 8 (not separately shown) that have been wired to provide video to a cockpit display (not separately shown) from a WALLEYE weapon (not separately shown) that may be carried on these stations.

Figure 4:
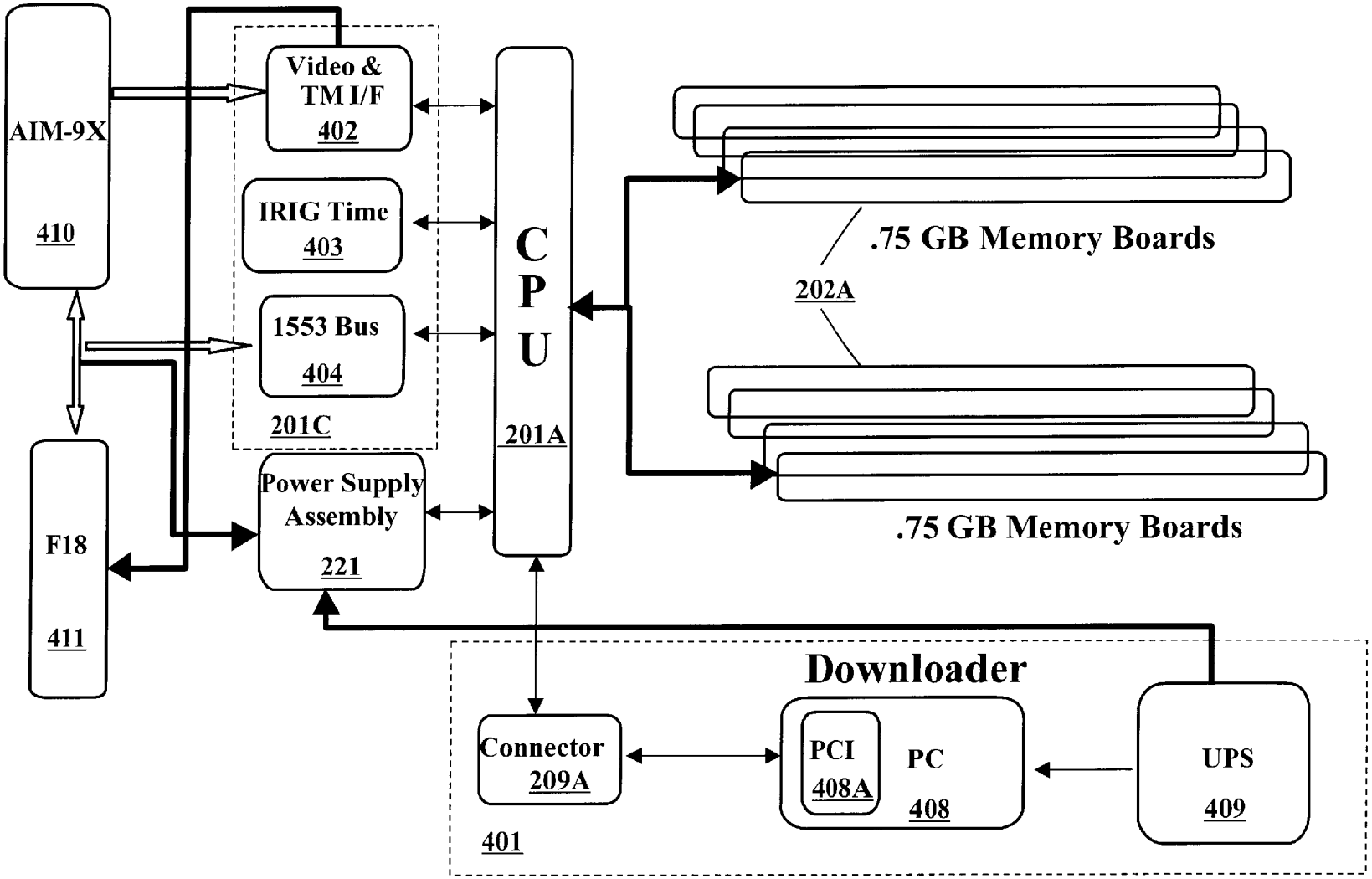
FIG. 4 is an overview schematic of the operation of a preferred embodiment of the present invention as would be installed in an F/A-18 aircraft that is employed in a captive carry test of an AIM-9X missile.

Referring to FIG. 4, by viewing what the missile 410 seeker sees in real time, the pilot may report in real time the display together with the contents of his Heads-Up Display (HUD) (not separately shown) and any audio tones received directly from the missile's electronics. This information can also be reviewed in post-mission pilot or operator de-briefs.

Self-contained data acquisition permits the aircraft to operate in areas otherwise unavailable due to frequency allocation authorization, availability of ground telemetry sites, and adverse geometry due to geographical or other physical interference. For example, data can be acquired from a full range of "target backgrounds," such as urban scenarios with smog and man-made structures; mountain scenes with sharp discontinuities, forests, snow fields, and tree lines; valleys with crops in various stages of growth; and even oil fields and power stations. Data thus acquired can be input to complex simulations, thus easily saving thousands of hours of expensive flight-testing. Self-contained recording also permits missile design engineers to replay and analyze event chronology as re-created from the downloaded video and telemetry (TM) data.

The advantage of not having to obtain frequency allocation for every test flight is significant. For example, telemetry from an AIM-9X uses one-third of the lower S-band frequency band, a band that is often used for higher priority purposes, thus limiting the time windows in which testing can be done. In addition, since the self-contained data acquisition package does not move with respect to a data recorder, there is minimal chance for data dropout as occurs often in flight-testing using ground telemetry recorders for data acquisition. With I-DAP 100, a simple portable download device, 401 in FIG. 7, incorporating a portable computer 408 with at least one large disk drive 704 that may be removable, can download a full one-hour mission of "hard-wire recorded" data with few, if any, data dropouts, immediately after the aircraft lands.

Figure 5:
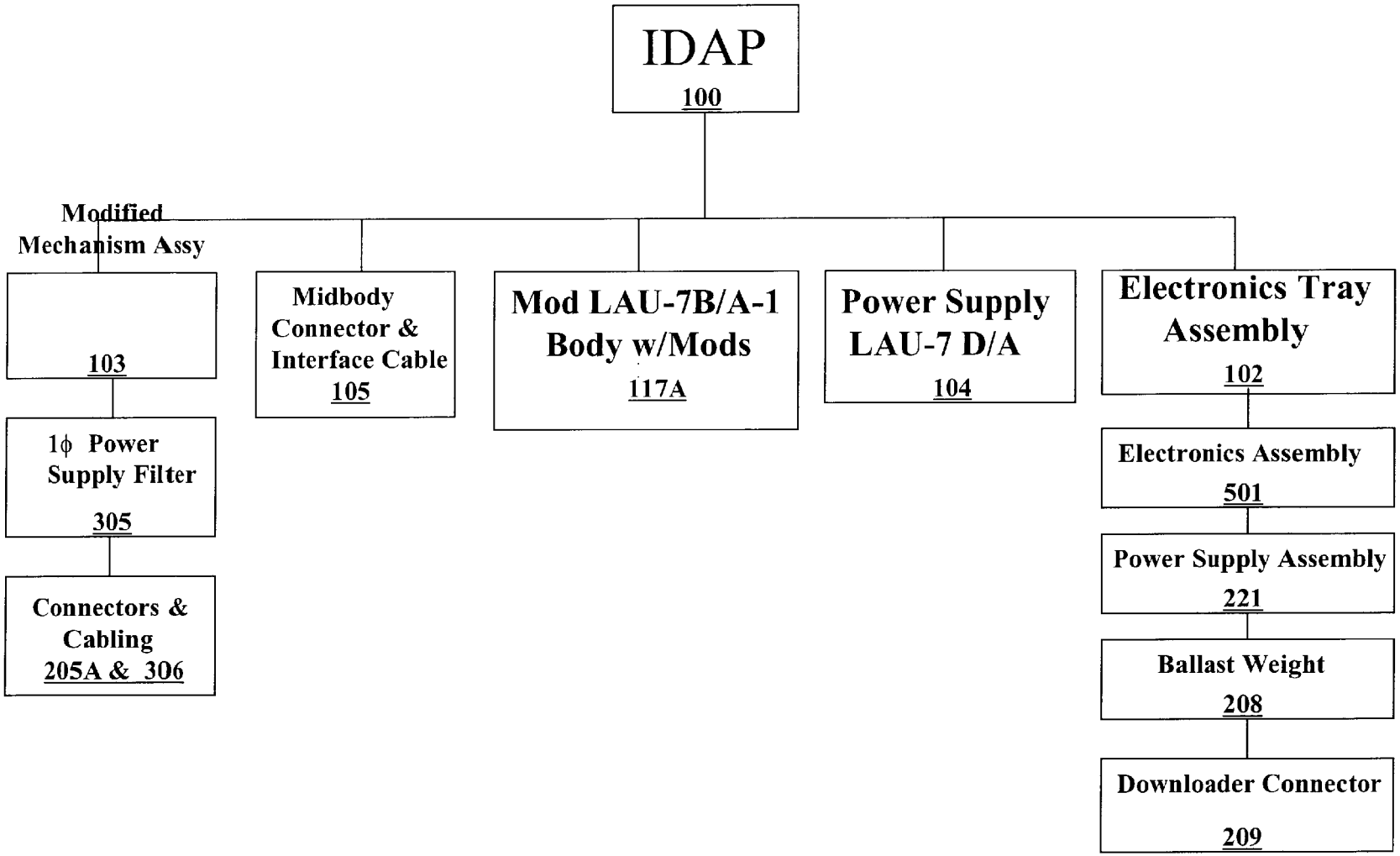
FIG. 5 is a block diagram of the major components of a preferred embodiment of the present invention as they may be incorporated into a LAU-7 missile launcher.

FIG. 5 shows a block diagram of the major subassemblies within the LAU-7 missile launcher pod as modified to be designated I-DAP 100. These are the modified LAU-7 missile main body 117A, designated LAU-7B/A-1, the midbody connector and interface cable 105, the modified mechanism assembly 103, the LAU-7 D/A power supply assembly 104, and the electronics assembly tray 102. The modified mechanism assembly 103 includes added connectors 205A and 306, modified cable (not separately shown), and the single-phase (1Φ) power supply filter 305. A power supply assembly 104, designated the LAU-7D/A power supply, is obtained as a COTS unit and installed without further modification, replacing the PP 2581 power supply 104A.

Figure 2A:
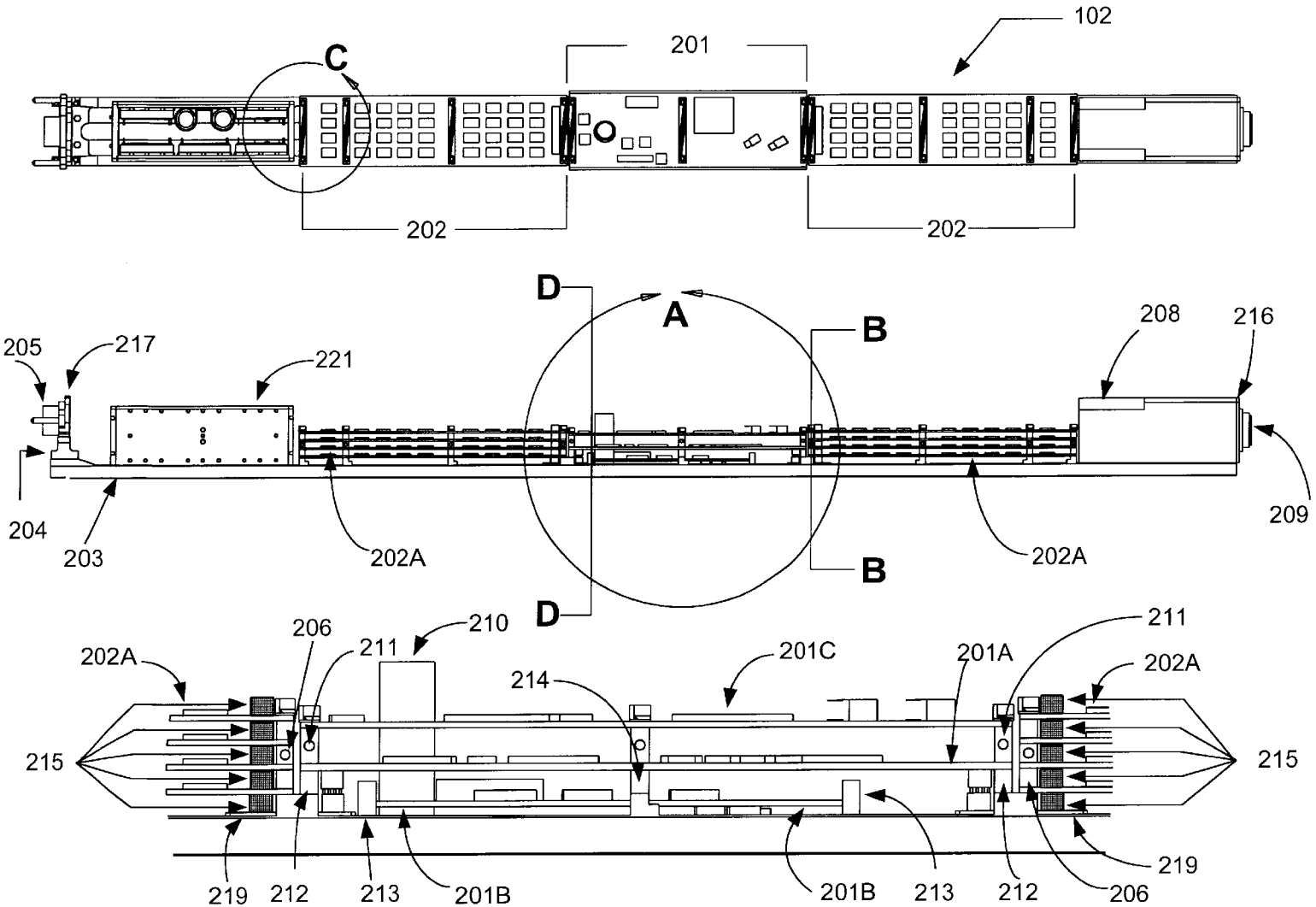
FIG. 2 represents a detailed profile, plan, and sectional views of a preferred embodiment of the present invention used to record data from a captive carry test of a missile.
Figure 2B:
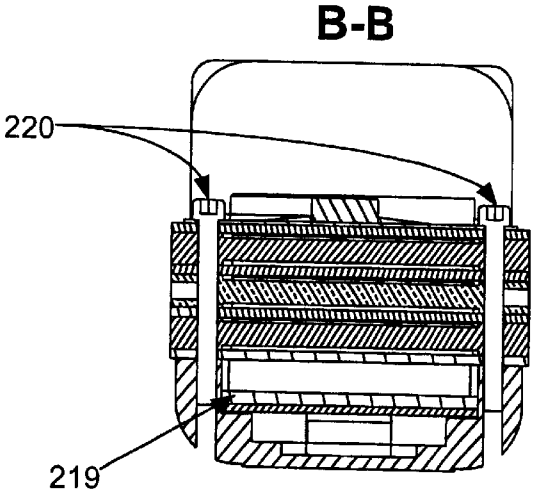
Figure 2D:
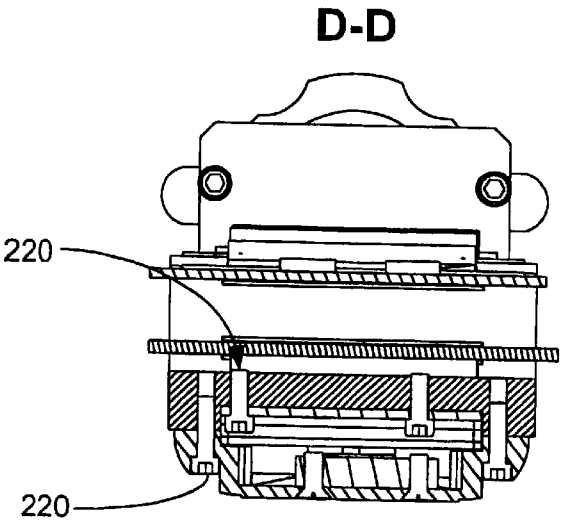
Figure 2C:
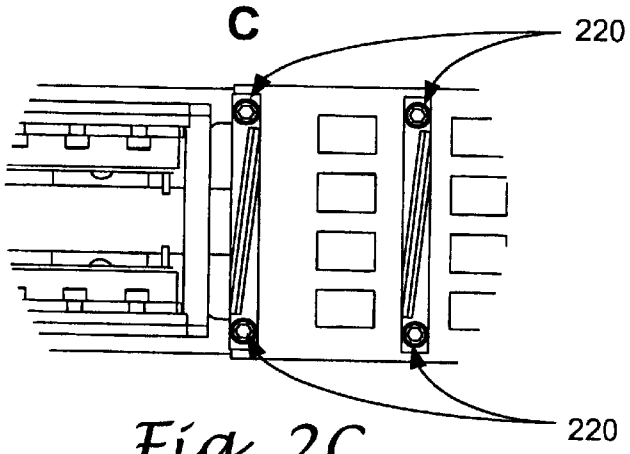
Figure 3:
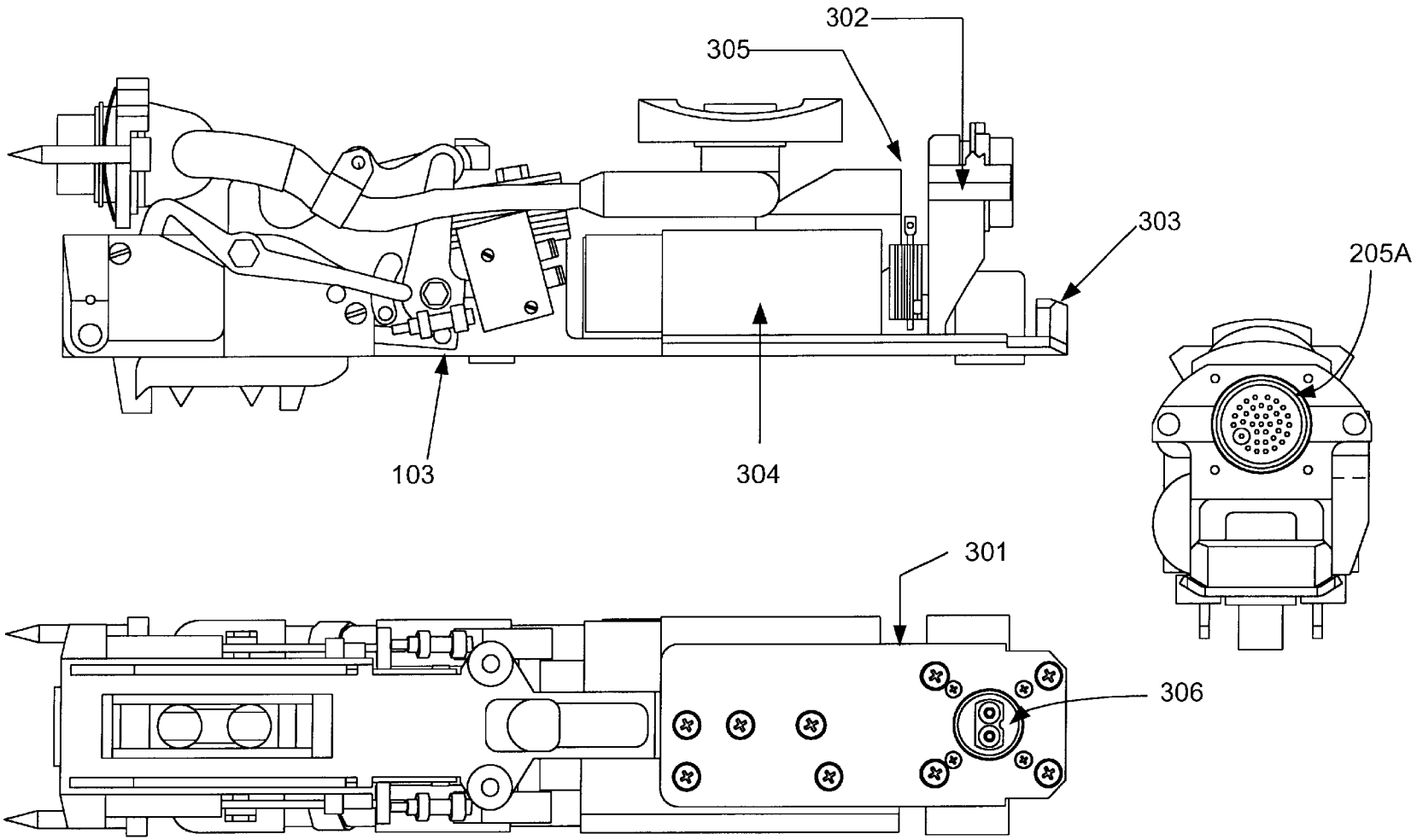
FIG. 3 represents two views of a modified mechanism assembly of a preferred embodiment of the present invention as well as an end view of the connector used for signal and power transfer to the onboard data recorder.

The electronics tray assembly 102 is specially fabricated. It contains a four-level circuit board assembly termed the electronics assembly 501 and further described below, a ballast weight 208, a modular power supply 221 with five parts, and a connector 209, such as a round 128-pin connector for attachment to the downloader 401. Referring to FIGS. 2 and 4, a specific electronics assembly 501 contains 8 memory boards 202A of 0.75 Gb capacity each for a total capacity of 6 GB flash random access memory (RAM), a CPU board 201A for control, an I/O board 201C having the MIL-STD-1553 bus 404 for communication, the video/TM 402 for pulling data from the missile and related sensors, and an IRIG timer 403 for synchronizing the data, a backplane board 201B for signal and power interfaces, two jumper boards 219 for interconnection, and necessary tray cabling 602 between the board connectors 215, connector bracket 217, fasteners 220, examples of which are shown in FIG. 2D, and board spacers 206, 211 thru 214.

Figure 6:
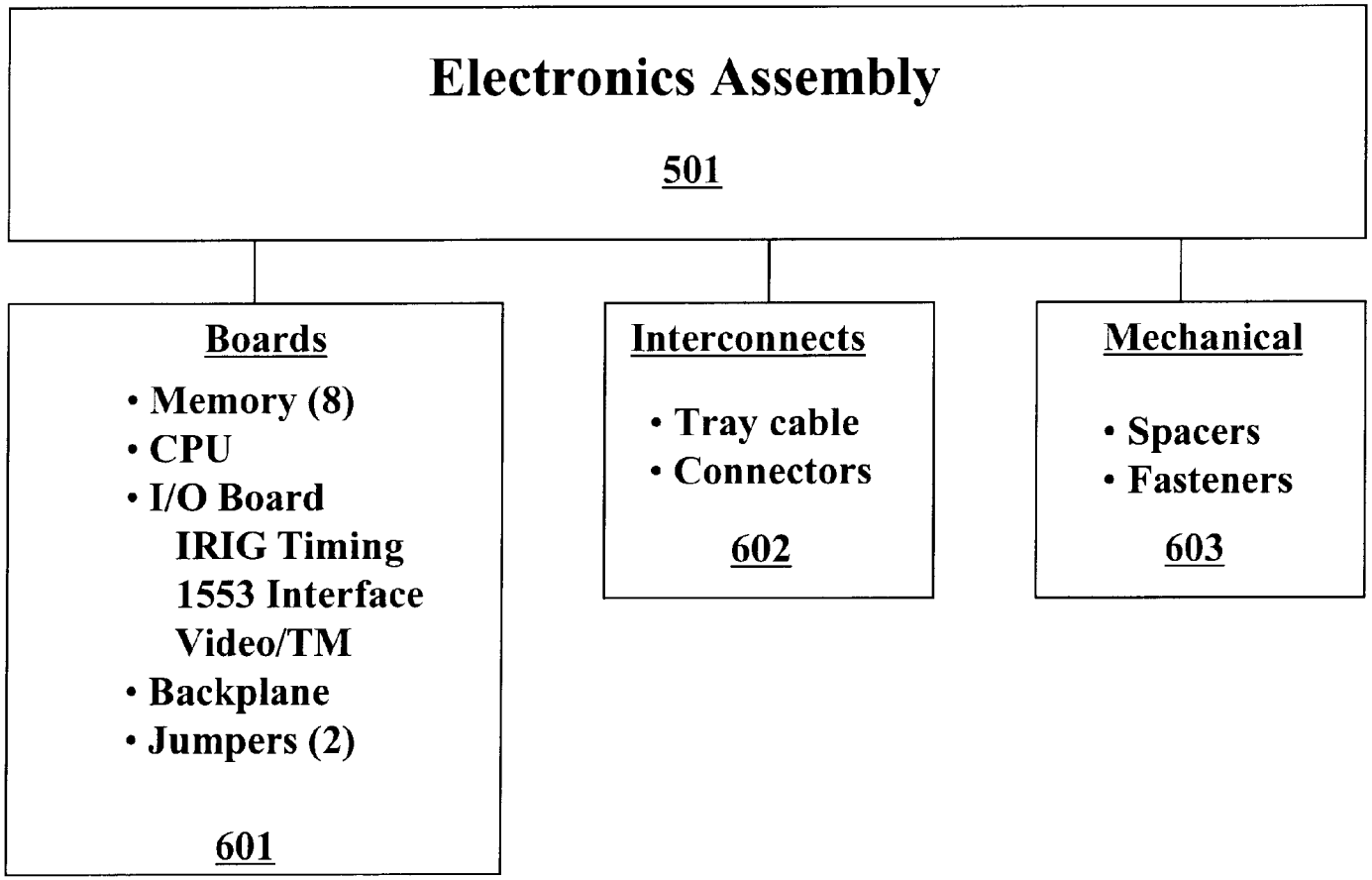
FIG. 6 is a block diagram of the components of the electronics assembly of a preferred embodiment of the present invention.

The electronics assembly 501 is further described by reference to FIG. 6. The circuit boards 601 comprising it include the eight 0.75 GB memory boards 202A; the CPU board 201A; the I/O board 201C combining the IRIG timing generator 403, the MIL-STD-1553 bus 404 and the video/TM interface circuitry 402; the backplane board 201B, and the two jumper boards 219. The electronics assembly interconnects 602 include electrical parts such as the tray cable and all electrical connectors (all not separately shown). Mechanical parts 603, such as fasteners 220 and spacers 206, 211 thru 214, all mounted to the tray 203 that ties the electronics assembly 501 together to facilitate operation under severe environmental conditions.

Figure 7:
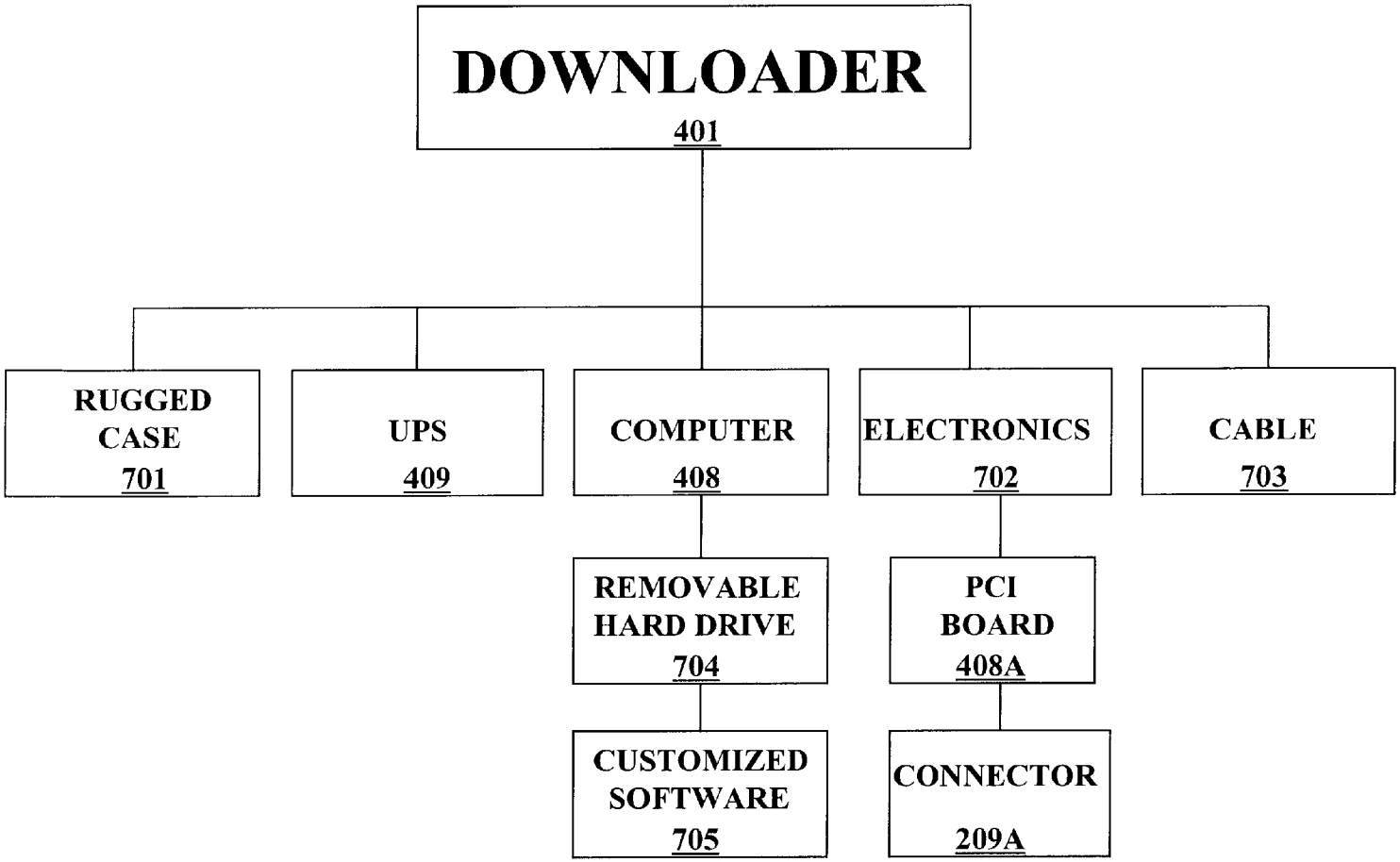
FIG. 7 is a block diagram of a downloader that may be used as part of a preferred embodiment of the present invention during operational testing requiring robust packaging.

Referring to FIG. 7, a portable downloader 401 for down loading the data from the I-DAP 100 may consist of 5 sub-assemblies as shown. The heart of the system is the computer 408, an example of which is a Dolch COTS unit with removable hard drive 704 and customized software 705 that may be run on the WINDOWS NT® operating system. The power supply 409 may be any suitable uninterruptable power supply (UPS) available commercially, e.g., one made by the APC Corporation for battery backup to AC-powered computer systems that one does not wish to go offline in the event of a power disruption. Because the downloading may occur in an operational scenario on a flight line or even on an aircraft carrier, the downloader 401 should be packaged in a rugged case 701 and access data over a ruggedized cable 703 to protect it from adverse environmental conditions. The electronics 702 associated with the downloader 401 include a specially fabricated PCI board 408A and a connector 209A.

A system block diagram for the I-DAP 100 as installed on an aircraft is provided in FIG. 4. Shown as the control electronics for the I-DAP is the CPU 201A which establishes communication between the aircraft, e.g., an F/A-18 411, the missile, e.g., an AIM-9X 410, and the recorder (shown as a series of 0.75 GB memory boards 202A). To effect time-correlated, standardized data acquisition provided are: a time code generator 403 providing IRIG time, video and telemetry (TM) circuit 402 providing missile seeker video and TM data, a MIL-STD-1553 data bus 404 on which data are received, and a modular power supply 221 for use by all the circuitry on the electronics assembly tray 102. Also shown are the downloader's 401 power source, a COTS UPS 409, the PC 408 and the specially developed PCI board 408A. An integral part of the downloader 401 is the computer's hard drive (not separately shown) which may be removable to enhance security.

Additionally, incorporated by reference herein are the *IDAP Electrical Schematic Diagrams*, Nov. 30, 1999.

EXAMPLE

The attention to detail needed in accomplishing the re-configuration of an operational system is seen in the following description of tasks accomplished in effecting a preferred embodiment of the present invention.

A preferred embodiment of the present invention modifies a LAU-7 launcher pod 101, which may be affixed to the wingtip of an F/A-18, with an integral data acquisition package. The LAU-7 101 is thus modified while maintaining:

- weight and center of gravity (CG)
- moment of inertia (MOI), in particular pitch MOI 106 related to the F/A-18 wingtip
- strength and integrity of the LAU-7 101
- adequate physical support so that the new components are not a flight hazard functional operating features of the LAU-7 101 and its missile system 410

Referring to FIG. 4, a preferred application for this system is captive carry testing of an AIM-9X SIDEWINDER 410 on the wingtip of an F/A-18 411. In addition to digital video and data acquisition, the system formats AIM-9X seeker (not separately shown) video for display in the cockpit (not separately shown).

Refer to FIG. 1. All station reference numbers are with respect to the front of the launcher body 117 shown in FIG. 8 except as noted otherwise. An unmodified LAU-7 main body 119, with front 111 and aft 112 fairings installed, is 110.9 in. long, 5.5 in. deep, and 4.2 in. wide, not including the mounting bolts 107A, B. In conventional configuration for the predecessor to the AIM-9X, e.g., the AIM-9M, the LAU-7 weighs 85 lb. (nominal) in a flight-ready condition with a full $N_2$ bottle 120 and both mounting bolts 107A, B, and has a moment of inertia of 64,800 $lb_m$-$in^2$ about its center of gravity (CG) through a vertical axis. The CG is 13.66 in. behind the centerline of the front mounting bolt 107A. The mounting orientation of the IDAP 100 on the F/A-18 wingtip (not separately shown) is horizontal, i.e., extending the length of the wing rather than under the edge of the wing, so the moment of inertia 106 is in the aircraft pitch axis.

Referring to FIG. 1, the main body 119 is an aluminum alloy extrusion with many machined features. The top of the main body 119 has two 0.750–16 bolts 107A, B for attaching it to the aircraft (not separately shown), and an electrical connector 113 behind the forward bolt for all aircraft electrical interfaces accessed via the aircraft's wingtip (not separately shown). The mounting bolts 107A, B are on the centerline of the main body 119 and 30 in. apart. The centerline of the front bolt 107A is at launcher body 117 station number 39.437, measured from the tip of the front fairing 111. The bottom part of the main body extrusion as shown in an end view 116 has L-shaped rails 118 that retain the AIM-9 missile launch hangers (not separately shown) mounted on the rocket motor (not separately shown). The rails 118 guide the hangers as the missile is fired. The empty main body 119, without forward/aft fairings 111, 112, attached parts, or internal parts, is 89.1 in. long and weighs approximately 37 lb.

Several small parts are attached to the main body 119, along with the forward 111 and aft 112 fairings described below. Three major subassemblies, described below, are mounted inside it. Along the top of the main body 119, in line with the attachment bolts 107A, B, are two sheet metal pylon adapters 114, 115. The forward pylon adapter 114 is 20.0 in. long and weighs 0.57 lb. including a quick-release pin (not separately shown) attached to a cable (not separately shown) and mounting screws (not separately shown). It extends forward from the front launcher mounting bolt 107A. The aft pylon adapter 115 is 41 in. long and weighs 0.942 lb. without screws. It extends back, starting just aft of the launcher-to-pylon electrical connector 113. Both pylon adapters 114, 115 are 2.7 in. wide.

At the front of the main body 119 are two spring assemblies 109 that clip onto AIM-9M canards (not separately shown) to keep them stationary. Together with the four mounting screws (not separately shown), the weight is 0.74 lb. (total for canard clips on both sides). There is also an umbilical snatch-away assembly (not separately shown) that weighs 0.828 lb., including its four mounting screws (not separately shown). It acts as a brace to shear the forward umbilical attachment screws when the missile is fired. Then it pulls the loose end of this umbilical (not separately shown) out of the missile's path.

At the back of the main body 119, a 0.42 lb. bottle toggle clamp (not separately shown) for the $N_2$ bottle 120 is attached with four screws (not separately shown). A rocket motor blast deflector (not separately shown), weighing 0.51 lb., including one additional screw, is also attached there using mounting screws in common with the bottle clamp. Note that the blast deflector attachment is modified and the $N_2$ bottle toggle clamp is removed when the main body 119 is modified for use as the I-DAP 100. Other main body 119 modifications for the I-DAP 100 include a hole pattern (not separately shown) bored into the bottom of the main body 119 to accommodate the screws that attach the electronics tray 203 and a large hole (not separately shown) bored into the bottom of the main body 119 to provide access to the connector 306 on the modified mechanism assembly 103.

When the aft fairing 112 is installed on the main body 119, a snubber assembly (not separately shown) is put in place. The snubber design for the LAU-7B/A-1 main body 117A is a block snubber (not separately shown). The block snubber has a loose sheet metal plate (not separately shown) held captive between the launch rails 118, constrained by a short, thick pin (not separately shown).

When the I-DAP 100 is installed on the aircraft (or removed), a hex wrench (not separately shown) must pass through it from bottom to top, where the attaching bolt 107A, B heads are located. There is an identical wrench access cover assembly (not separately shown) for each of the two bolts 107A, B, consisting of a cover plate, sliding cover, and two mounting screws. Each of these two cover assemblies weighs 0.086 lb. The sliding cover can be opened or shut by hand, but it is pressed shut by aerodynamic force in flight.

The forward end of the I-DAP 100 has a cast forward fairing 111 with small clamshell doors (not separately shown) which provide access to the missile's forward umbilical connector (not separately shown). The whole fairing assembly 111 slides forward for opening. When closed, it extends 15 in. forward from the main body 119 section that has a full cross-section 116 as shown in FIG. 1. The forward fairing 111 weighs 2.617 lb. and does not require mounting screws. It does have a single screw (not separately shown) to limit sliding travel range.

The aft fairing 112 is a two-piece cast aluminum housing attached to the back of the main body 119 with a long pivot rod (not separately shown). The 2 pieces slidey back a fraction of an inch, then swing open clamshell fashion for access to the $N_2$ bottle 120. Closing the clamshell halves causes spring loading on the snubber parts that push the missile away from the launcher 101. The aft fairing 112 with pivot rod assembly weighs 5.103 lb. (without snubber parts or mounting screws). It extends back 19.75 in. behind the main body 119 section that has a full cross section 116. The release lever 108 for opening this fairing 112 includes a cam (not separately shown) which operates the snubber assembly.

All of the above parts are lumped together with the main body 119 as the "rest of the launcher," to distinguish them from the interior assemblies which are more frequently changed. An averaged weight for the "rest of the launcher" was calculated as 48.52 lb. Measured, and then summed, weight for the I-DAP "rest of the launcher" is 50.61 lb. The calculated CG of the I-DAP "rest of the launcher" is at LAU-7 station number 54.77 in., which is 15.33 in. behind the centerline of the forward launcher mounting bolt 107A.

The LAU-7 D/A power supply assembly 104 occupies the forward section of the I-DAP 100. It is retained by two ¼-28 flat head screws (not separately shown) 12.312 in. apart along the centerline. It is 17.34 in. long (ignoring the connector extensions) and weighs 9.63 lb. The missile's forward umbilical (not separately shown) attaches to a connector (not separately shown) on the front of the power supply assembly 104. A similar connector (not separately shown) on the back of the power supply assembly 104 plugs into a spring-loaded and pin-guided connector (not separately shown) on the modified mechanism assembly 103 with blind mating. The power supply assembly 104 is 3.95 in. high and 3.75 in. wide; it fits into a portion of the I-DAP 100 that has its extruded interior enlarged by machining. The CG of the power supply assembly 104 is at LAU-7 station 24.13, which is 15.31 in. ahead of the front launcher mounting bolt 107A centerline. The modified mechanism assembly 103 is a complex unit located at the forward launcher mounting bolt 107A area. It has a clearance hole (not separately shown) through it for wrench access to the bolt 107A. This unit is 14.98 in. long, not including the forward connector extension (not separately shown), 3.0 in. wide, and 3.5 in. tall. It has a weight of 9.36 lbs. including the eight mounting screws. A spring-loaded connector with guide pins (not separately shown) is on the front of this assembly 103 for interface with the power supply assembly 104. There is also a connector 113 on top of it for interface to the aircraft. Each of these connectors is attached to the launcher main body 119 with two #10-32 screws (not separately shown).

Two large conical striker points (not separately shown) on the bottom of the modified mechanism assembly mate with the rocket motor firing terminals, although only one is used. These striker points are surrounded by snubbers (not separately shown) that push the missile away from the I-DAP 100, and by detents (not separately shown) that prevent the missile from sliding off the launcher rails 118, shown in end view in FIG. 1, unless it is purposely fired. Via access through the side of the I-DAP 100, a detent wrench (not separately shown) releases these spring-loaded parts for missile up-loading and down-loading. In addition, a quick-release pin (not separately shown) must be installed for flight. It is attached by a cable (not separately shown) to the forward pylon adapter 114. The modified mechanism assembly 103 is attached to the LAU-7 main body 119 with four fasteners (not separately shown). Two are 5/16-24 bolts through the sides of the I-DAP 100. Two ¼-28 screws are at the bottom of the modified mechanism assembly 103 casting.

The modified mechanism assembly 103 has three large parts mounted on a formed aluminum plate, referred to as the tongue plate 301. The parts are:

master arm solenoid 304 electrical filter 305 for 400 Hz AC and the connector mount 302

The front of the tongue plate 301 attaches to the modified mechanism assembly 103 casting with two #10-32 screws (not separately shown). The modified mechanism assembly 103 is wired with heavy-duty cabling (not separately shown).

The functions of the modified mechanism assembly 103, quick-release pin, detent wrench and master arm solenoid 304 are not changed by conversion of the LAU-7 to a preferred embodiment of the present invention, i.e., an I-DAP 100.

On a conventional launcher for the AIM-9M, the $N_2$ bottle 120 occupies the back section of the main body 119. (No $N_2$ bottle 120 is needed on aircraft that are to carry the AIM-9X, although the same LAU-7 launcher may be used that is employed with the AIM-9M.) The bottle's 120 forward end screws into threads on the solenoid valve (not separately shown) in the mechanism assembly 103A. The aft end is supported by a toggle bottle clamp (not separately shown) in the aft fairing 112 area. The bottle 120 is 3.5 in. in diameter by 52.31 in. long, not including the threaded attachment fitting. An empty bottle 120 weighs 12.05 lb., while a full bottle 120 (3000 psi $N_2$) weighs 14.95 lb. The bottle 120 must be removed to load or unload a launcher 101 from the aircraft since it blocks access to the aft launcher mounting bolt 107B. The CG of a full $N_2$ bottle 120 is at LAU-7 station 76.28 in.

The LAU-7 launcher 101 is modified as follows to allow autonomous onboard data acquisition. The I-DAP data acquisition system carried on the tray assembly 102 is a long electronics package that slides into the LAU-7 main body 119 volume normally occupied by the $N_2$ bottle 120. It requires 10 mounting screws (not separately shown) and 1 cable opening (not separately shown) through the bottom of the main body 119. In addition to this all-new assembly, the LAU-7 power supply assembly 104A is replaced with a LAU-7D/A power supply assembly 104 designed for AIM-9X use, and the mechanism assembly 103A is electrically and mechanically modified. Modified mechanism assembly 103 modifications provide the following functions:

- MIL-STD-1553 bus 404 address and data lines to the AIM-9X umbilical (not separately shown) from the aircraft connector 113
- AIM-9X imaging video output 402 to the aircraft from the data acquisition system connector 205A
- connector 306 to interface the modified mechanism assembly 103 to the missile mid-body umbilical 105 for video and data to the data acquisition system 110
- AIM-9X filter assembly 305 to replace the existing 400-Hz filter in the modified mechanism assembly 103
- replacement of the $N_2$ bottle 120 solenoid valve (not separately shown)

Further, there are some minor "fitting" changes made to the LAU-7 main body 119 and the aft $N_2$ bottle 120 clamp (not separately shown) is removed from the launcher 101.

No mechanical modifications are required to the forward fairing 111. A preferred embodiment of the present invention will test the AIM-9X version of SIDEWINDER and its "forward" umbilical (not separately shown) is physically compatible with the AIM-9L/9M umbilical and with the LAU-7D/A power supply assembly 104. The canard retaining clips 109 do not fit the fixed forward fins (not separately shown) on AIM-9X, but these clips do not have to be removed from the main body 119. The existing umbilical snatch-away assembly is retained.

The external configuration, mounting screws, and electrical connectors for the LAU-7D/A power supply assembly 104 are not changed. The weight of this power supply assembly 104 is a measured 9.63 lb. and its CG is at LAU-7 station 24.125 in. The estimated MOI about its CG is 240.4 $lb_m$-$in^2$.

The modified mechanism assembly 103 incorporates wiring modifications without "factory molded" coverings. They are routed and secured to prevent damage from any of the moving mechanical parts in this assembly. The following are not affected by changes:

- wrench access for the forward launcher mounting bolt 107A
- the functions of the detent wrench used for missile loading and downloading
- quick-release pin installed for flight
- operation of the master arm solenoid 304

The re-worked modified mechanism assembly 103 weighs 9.34 lb. including its eight mounting screws. The CG of the modified mechanism assembly is at LAU-7 station 38.53 in.

The nitrogen solenoid valve assembly (not separately shown) is removed from the tongue plate 301 and the tongue plate 301 is shortened by 1.77 in. to allow space for the electronics assembly tray 102. This eliminates the back two nut plates (not separately shown) where the tongue plate 301 was attached to the bottom of the launcher main body 119, but it also eliminates most of the load that these mounting screws carried, i.e., the $N_2$ bottle 120. A small block, termed a tongue depressor 303, is attached to the shortened end of the tongue plate 301. It extends under the front end of the tray assembly 102 to restrain the tongue plate 301 from vertical motion at its aft end.

Two new connectors are attached to the tongue plate 301. The first connector 205A is nearly identical to the connector (not separately shown) on the back of the power supply assembly 104, and is set up for blind mating with a compatible pin-guided connector 205 on the front of the tray assembly 102. A connector mount 302 is used to support this connector. The other connector 306 is used for routing AIM-9X video and TM data 402 into the modified mechanism assembly 103 from the AIM-9X mid-body umbilical 105 located just behind the AIM-9X forward motor hanger (not separately shown). The tongue plate 301 mounted connector 306 will extend 0.125 in. below the bottom surface of the tongue plate 301, dropping into a new 1-in. hole (not separately shown) through the main body 119. It has been verified that the extension of this connector 306 will not interfere with installation of the modified mechanism assembly 103 into the main body 119. During flight with an AIM-9X missile, a commercially fabricated cable 105 will be installed. When this modified launcher 100 is flown without an AIM-9X SIDEWINDER, a secure-locking protective cap (not separately shown) for this connector 306 provides environmental protection.

A new 400-Hz AC filter 305, designed specifically for AIM-9X, is mounted on the tongue plate 301 and has external dimensions and mounting locations identical to the replaced filter (not separately shown). It may need minor re-location of its wiring (not separately shown) to clear the connector mount 302 and the connector 205A mounted on it. Weight and CG changes for the new filter 305 are minimal.

The electronics tray assembly 102 consists of three stacks of circuit boards attached to a 49.93×2.86 in. aluminum tray 203. This assembly must pass through the minimum cross section area of the main body 119 extrusion, so it has a smaller cross sectional area (3.05 in. high×3.5 in. wide) than the power supply assembly 104. The forward and aft board stacks 202 each have 4 nearly identical memory boards 202A; each of these boards 202A carries 0.75 GB of flash RAM, the forward and aft board stacks 202 thus providing a total of 6 GB of RAM. This is sufficient to store data from a nominal one hour captive carry test of the AIM-9X. The center board stack 201 contains a CPU board 201A, a backplane interface board 201B, and an input/output (I/O) board 201C. There are also two small jumper boards 219 of FIG. 2B for interconnections between the boards on the board stacks 201, 202. The board stacks 201, 202 are attached to the tray 203 with 1.5 in. #8-32 screws 220 in FIG. 2B that pass through the boards 201A, B, C, 202A and through aluminum spacers 206, 211, 212, 214. The jumper boards 219 are located only by their connectors (not separately shown). The weight of the tray assembly 102 is 16.22 lb., and its CG is at I-DAP 100 station 73.36 in. This includes the tray 203, circuit boards 201A,B,C, 202A, 219 and mounting parts (not separately shown), the forward connector 205, aft connector 209, modular power supply 221, a 2.66 lb. counterweight 208, and the tray wiring harness (not separately shown). The predicted MOI of this assembly about its CG is 4160 $lb_m$-$in^2$.

The circuit boards 201A,B,C, 202A, 219 are mounted parallel to the bottom of the I-DAP 100 to minimize board deflections during wingtip vibration, which is predominantly vertical with respect to the aircraft wingtip. The board stacks 201, 202 have numerous spacers 206, 211 thru 214 between circuit boards 201A, B, C, 202A and they are secured to the tray 203 by 1.5 in. #8-32 socket head screws 220 that go through the board stacks 201, 202. The threads in the tray 203 for these screws have helicoil inserts (not separately shown) for added strength and durability. The tray 203, CPU board 201A, I/O board 201C, and backplane board 201B each have a large hole (not separately shown) through them for wrench access to the back launcher mounting bolt 107B. Thus, the I-DAP 100 can be removed from the aircraft without disassembly of the interior components, i.e., the board stacks 201, 202. The tray 203 is attached to the main body 119 with five pairs (10 total) of ¼-28 flat head screws (not separately shown). Each pair (except for the back pair having wider spacing) is separated by 1.1 in. instead of being on the centerline as are the screws (not separately shown) that mount the power supply assembly 104. This is to provide more resistance to vertical vibration of the wingtip.

The front of the tray 203 supports a pin-guided floating connector 205 nearly identical to the one on the front of the modified mechanism assembly 103. A connector mount 204 is the interface between the floating connector assembly 217 and the tray 203. During captive carry of the AIM-9X, power and all signal functions go through this connector 205 to the tray assembly 102. It also has a feature to limit movement of the back of the modified mechanism assembly 103 tongue plate 301 since its two back mounting screws were removed in the modification.

Immediately behind the connector mount 204 is a modular power supply 221 built up on an open rectangular aluminum box. This provides +5 VDC, +3.3 VDC, and ±15 VDC to run the I-DAP 100 electronics during a captive carry flight. This assembly weighs approximately 2.26 lb.

The bare cast tooling plate tray 203 is made with a thick cross section to add strength. The tray 203 is mounted with 10 screws (not separately shown); the aft two were located further apart than the others to clear the aft clamshell pivot rod (not separately shown) and the blast deflector (not separately shown). The tray 203 is designed to slide into the main body 119 without removing the aft clamshell assembly 112. Helicoils in the tray 203 have a length twice the screw diameter. The board stacks 201, 202 are made as short as possible, thus putting less loading on the structure when it encounters vibration. The wrench tube 210 is made of stainless steel for better wear resistance.

The back of the tray has a 2.66 lb. counterweight 208 to establish the correct weight, CG, and moment of inertia for the modified launcher 100. Attached to the back of the counterweight 208 is a connector mounting plate 216 with a large round 128-pin electrical connector 209. This connector 209 provides DC power to the electronics on the electronics tray assembly 102 when downloading data to a portable computer's 408 hard drive after the aircraft has landed and aircraft power is off. It also allows synchronization of the IRIG clock 403 that is contained on the circuit board 201C in the I-DAP 100. Data cabling 703 is run in parallel, with differential line drivers (not separately shown) accounting for 64 of the 128 possible wire connections. Access to this connector 209 requires only opening the back clamshell covers on the I-DAP 100. Near the center of the tray 203, a wrench tube 210 is attached to limit freedom of the hex wrench used to attach the I-DAP 100 on the aircraft. This prevents the wrench, or the large bolt from contacting the boards as the bolt is being positioned.

The aft fairing 112 and its mounting (not separately shown) are unchanged from the standard launcher 101 configuration. The $N_2$ bottle 120 clamp is removed from this area. The two screws that retain the blast deflector were originally threaded into the bottle clamp. Their direction is reversed, with lock nuts added below the blast deflector. The main body 119 is modified with countersinks (not separately shown) in the original mounting holes (not separately shown) to allow installation of these screws without interference to the tray 203.

The modular power supply 221 provides internal power during captive carry flight, providing +5 VDC, +3.3 VDC and ±15 VDC to the electronics on the I-DAP electronics assembly tray 102. The ±15 VDC is developed from the aircraft's +28 VDC power while the +5 and +3.3 VDC supplies for the logic circuits (not separately shown) are developed from the aircraft's 110 VAC 400-Hz power. For downloading, +5 VDC and +3.3 VDC only are supplied by the downloader 401 UPS 409. Each modular supply must be compatible with reverse application of 5 and 3.3 VDC when the modules are unpowered on their input side but have voltage supplied to their output terminals by the downloader 401. There are no steering diodes for isolation.

All circuit boards 201A, B, C, 202A, 219 use through-hole stacking connectors 215. This provides a more robust interconnect scheme than surface mount stacking connectors. The through-hole connectors 215 are self-aligning and do not require precision alignment fixtures for assembly to the circuit boards.

IRIG 403, video 402, and MIL-STD-1553 bus 404 data are combined on one I/O circuit board 201C. Various high frequency coax and triax lines (not separately shown) are routed outboard of the wiring harness and stacking spacers 206, 211 and 214 with board-mounted coax connectors (not separately shown) incorporated in the I/O circuit board 201 C.

The backplane board 201B has relays for the MIL-STD-1553 bus 404 address lines. This allows I-DAP 100 to pass pre-flight tests when unpowered, a standard check-out procedure before flying AIM-9X. Line drivers, for the parallel output lines that download data, are also located on the backplane board 201B. This allows longer wiring runs, so downloading can be done at the back of the I-DAP 100 without removing the missile or any cover plates. It is only necessary to open the aft fairing 112 for access.

LAU-7B/A-1 launchers 101 were modified for this effort. These have a different snubber design at the aft fairing 112 area than prior LAU-7 versions, and have a radar absorbent coating applied to their outside surface. They also mount the $N_2$ bottle 120 clamp and the blast deflector differently from their predecessors.

Mass properties of the I-DAP 100 were measured. MOI data is for the pitch axis 106 of the F/A-18 when the I-DAP 100 is mounted on a wingtip.

Measured mass properties without the mid-body cable 105 attached are:

| | |
|---|---|
| Weight | 86.98 ± 0.1 lb. |
| CG | 13.92 ± 0.05 in. behind centerline of the forward mounting bolt 107A |
| MOI | 62635 ± 313 $lb_m$-$in^2$ about the pod's CG |

Measurements for the same launcher pod 101 with a nearly full (2800 psi) $N_2$ bottle 120, before I-DAP modifications, are listed below.

| | |
|---|---|
| Weight | 86.69 ± 0.1 lb. |
| C.G. | 13.63 ± 0.05 in. behind centerline of forward mounting bolt 107A |
| MOI | 64248 ± 313 $lb_m$-$in^2$ about the launcher pod's 101 CG |

The above descriptions should not be construed as limiting the scope of the invention but as mere illustrations of preferred embodiments. For example, although examples discussed at length the LAU-7 launcher 101 and the AIM- 9X missile 410, the method and apparatus is applicable to any missile, launcher, or other weapon system that may be tested in captive carry mode. Further, the invention may be used with any device that needs to be tested or monitored on any platform in any medium where onboard data acquisition is desired. For example, an application would be for sensor systems used on an automobile to record performance data, providing a warning when routine maintenance is due or a catastrophic failure is imminent. The scope shall be determined by appended claims as interpreted in light of the above specification.

We claim:

1. A method for configuring an instrumentation package to fit within a missile attached'to an aircraft to test said missile during a simulated test flight of said missile comprising the steps of:

(a) removing a closed cycle cooling system from an interior of said missile;

(b) measuring available space within the interior of said missile after removing said close cycle cooling system from the interior of said missile;

(c) designing electronic modules for said instrumentation package to fit within said available space in the interior of said missile;

(d) fabricating said electronic modules;

(e) packaging said electronic modules to withstand environmental stress applied to said instrumentation package during the simulated test flight of said missile, and to fit within said available space in the interior of said missile, said instrumentation package including:

(i) a digital recorder having a flash RAM memory, the flash RAM memory of said digital recorder recording flight data received by said digital recorder for a time period of approximately one hour;

(ii) a multiplex data bus connected to said digital recorder;

(iii) a digital to analog converter connected to said multiplex data bus;

(iv) a plurality of sensors attached to said missile, said plurality of sensors being connected to said multiplex data bus, said plurality of sensors generating digital signals representative of said flight data;

(v) said digital to analog converter converting said digital signals to an analog format providing analog signals representative of said flight data; and (vi) said multiplex data bus transferring said digital signals from said digital recorder to said digital to analog converter for conversion to said analog format by said digital to analog converter; and (f) mounting said electronic modules within said available space in the interior of said missile.

2. The method of claim 1 wherein said aircraft having said missile attached thereto is controlled by an operator on board said aircraft.

3. The method of claim 1 wherein said instrumentation package when mounted within said missile eliminates a requirement for additional flight testing of said missile.

4. The method of claim 1 further comprising the step of downloading said analog signals representing said flight data to a porfitable data acquisition system having a monitor for viewing by an operator of said aircraft.

5. The method of claim 1 wherein said instrumentation package includes a battery connected to the electronic modules of said instrumentation package to supply DC power to the electronic modules of said instrumentation package.

6. The method of claim 1 wherein said closed cycle cooling system comprises a bottle of pressurized nitrogen.

7. The method of claim 1 wherein said aircraft comprises an F/A-18 aircraft.

8. The method of claim 1 wherein said missile comprises an AIM-9X missile.

* * * * *